US005363603A

United States Patent [19]

Miller et al.

[11] Patent Number: 5,363,603

[45] Date of Patent: Nov. 15, 1994

[54] ABRASIVE FLUID JET CUTTING COMPOSITON AND METHOD

[75] Inventors: Paul L. Miller, Minnetonka; Mark D. Stignani, Minneapolis; Gary G. Wittmer, New Hope, all of Minn.

[73] Assignee: Alliant Techsystems, Inc., Edina, Minn.

[21] Appl. No.: 901,804

[22] Filed: Jun. 22, 1992

[51] Int. Cl.[5] ..... B24C 1/00

[52] U.S. Cl. ..... 451/40; 451/39; 85/50; 89/1.1

[58] Field of Search ..... 51/321, 320, 410; 89/1.1; 86/50; 83/53, 177

[56] References Cited

U.S. PATENT DOCUMENTS

| | | | |
|---|---|---|---|
| 2,985,050 | 5/1961 | Schwacha | 51/321 |
| 4,478,368 | 10/1984 | Yie | 239/430 |
| 4,555,872 | 12/1985 | Yie | 51/321 |
| 4,723,378 | 2/1988 | Krasnoff | 51/410 |
| 5,010,694 | 4/1991 | Agbede | 51/429 |

FOREIGN PATENT DOCUMENTS

| | | |
|---|---|---|
| 0086616 | 8/1983 | European Pat. Off. . |
| 3602462 | 8/1987 | Germany . |

OTHER PUBLICATIONS

H. Blickwedel, et al., "Submerged Cutting With Abrasive Water Jets, " *Paper 27: Eighth International Symposium on Jet Cutting Technology* (1986).

R. A. Elvin, et al., "Abrasive Jet Cutting in Flammable Atmospheres–Potential Applications for Mining," (1985).

R. M. Fairhurst, et al., "DIAJET–A New Abasive Water Jet Cutting Technique," *Paper 40: Eighth International Symposium on Jet Cutting Technology* (1986).

I. Finnie, et al., "Erosion of Metals by Solid Particles," *Journal of Materials*, 2:682–700 (1967).

I. Finnie, "Some Observations on the Erosion of Ductile Metals," *Wear*, 19:81–90 (1972).

I. Finnie, "Erosion: Prevention and Useful Applications," *ASTM Special Technical Publication 664*, (1977).

I. Finnie, et al., "On the velocity Dependence of the Erosion of Ductile Metals by Solid Particles at Low Angles of Incidence," *Wear*, 48:181–90 (1978).

H. Haferkamp, et al., "Cutting of Contaminated Material by Abrasive Water Jets Under the Protection of Water Shield," *Paper F1: Ninth International Symposium on Jet Cutting Technology* (1988).

H. Haferkamp, et al., "Weiterentwicklung des Abrasivestrahl–Schneidverfahrens zum Trennen ferritishcher und austenitischer Stahle unter Wasser," (1990).

H. Haferkamp, et al., "Submerged Cutting of Steel by Abrasive Water Jets".

M. Hashish, "Steel Cutting With Abrasive Waterjets," *Paper K3: Sixth International Symposium on Jet Cutting Technology* (1982).

M. Hashish, "On the Modeling of Abrasive–Waterjet Cutting, " *Paper E1: Seventh International Symposium on Jet Cutting Technology* (1984).

M. Hashish, "Visualization of the Abrasive–Waterjet Cutting Process," *Experimental Mechanics*, Jun. 1988, pp. 159–169 (1988).

M. Hashish, "Pressure Effects in Abrasive–Waterjet (AWJ) Machining," *Journal of Engineering Materials and Technology* 111:221–28 (1989).

M. Hashish, "On the Effects of Material Properties in Abrasive–Waterjet Machining".

(List continued on next page.)

*Primary Examiner*—Robert A. Rose

*Attorney, Agent, or Firm*—Merchant, Gould, Smith, Edell, Welter & Schmidt

[57] ABSTRACT

The invention is an abrasive fluid cutting composition comprising a carrier fluid, and an abrasive. Preferably, the composition may also include a surface active agent. The invention also comprises a method for removing material from a substrate through application of the abrasive fluid of the invention comprising the steps of projecting the fluid composition onto the substrate. Reactive materials such as explosives, propellants, flammables, combustibles and the like may be cut using the composition of the invention.

11 Claims, No Drawings

OTHER PUBLICATIONS

M. Hashish, "Applications of Precision AWJ Machining".
M. Hashish, "Abrasive Jets," pp. 49–100.
M. Higgins, "Texas Firm Cuts Loose," *Cadence* 57–60 (May 1989).
R. H. Hollinger, "Precision Cutting With a Low Pressure Coherent Abrasive Suspension Jet," *Paper 24: Fifth American Water Jet Conference* (1989).
D. C. Hunt, et al., "A Parametric Study of Abrasive Waterjet Processes by Piercing Experiment," *Paper 29: Eighth International Symposium on Jet Cutting Technology* (1986).
D. C. Hunt, et al., "Surface Finish Characterization in Machining Advanced Ceramics by Abrasive Waterjet".
I. M. Hutchings, "Mechanisms of the Erosion of Metals by Solid Particles," Erosion: Prevention and Useful Applications, ASTM STP 664, American Society for Testing and Materials, pp. 59–76 (1979).
T. Isobe, et al., "Distribution of Abrasive Particles in Abrasive Water Jet and Acceleration Mechanism," *Paper E2: Ninth International Symposium on Jet Cutting Technology* (1988).
H. Y. Li, et al., "Investigation of Forces Exerted by an Abrasive Water Jet on a Workpiece," *Paper 7: Fifth American Water Jet Conference* (1989).
K. F. Neusen, et al., "Impact of Liquid Jets at Velocities Approaching Liquid Sound Speed," *Journal of Fluids Engineering* 198–202 (Sep. 1974).
"Superpressure Fluid Power: An Old Tool With a New Look," *Product Engineering* p. 59 (Apr. 26, 1971).
H. Yoshida, et al., "Concrete Cutting Using Rotary Water Jets," *Paper 12: Fifth American Water Jet Conference* (1989).
Database WPIL Week 9034, Derwent Publications Ltd., London, GB; AN 90-255100 & DE,C,3913479 (Koehler GMBH).
Database WPIL Week 9310, Derwent Publications Ltd., London, GB; AN 90-077572 & DE,A,4128703 (Rath D).

ABRASIVE FLUID JET CUTTING COMPOSITON AND METHOD

FIELD OF THE INVENTION

The invention generally relates to material finishing and cutting compositions and processes. More specifically, the invention relates to compositions and methods useful in removal of reactive and non-reactive materials from substrates through the application of abrasive fluids.

BACKGROUND OF THE INVENTION

Abrasive fluid or water jet cutting has been used for some time in applications limited to cutting material where damage to the surrounding substrate from heat, vibration, and other products of conventional cutting methods cannot be tolerated.

For example, Yie, U.S. Pat. No. 4,478,368, discloses a slurry water jet process for cutting steel and concrete. Further, I. M. Hutchings, *Mechanisms of the Erosion of Metals by Solid Particles,* Erosion: Prevention and Useful Applications, ASTM STP 664, W. F. Adler Ed., American Society For Testing Materials, 1979 pp. 59–76, discloses experiments that illustrate the behavior of spherical and angular particles on oblique impact with a metal surface. R. H. Hollinger et al, *Precision Cutting with a Low Pressure, Coherent Abrasive Suspension Jet,* 5th American Water Jet Conference, pp. 245–252, Aug. 29–31, 1989: Toronto, Canada, disclose conventional water/abrasive jet cutting using entrained abrasive particles in a water jet.

H. Y. Li et al, *Investigation of Forces Exerted by an Abrasive Water Jet on a Workpiece,* 5th American Water Jet Conference, pp. 69–77, Aug. 29–31, 1989: Toronto, Canada, disclose the development of practical procedures for the measurement of forces exerted on a workpiece in the impingement zone. K. F. Neusen et al, *Impact of Liquid Jets at Velocities Approaching Liquid Sound Speed,* Journal of Florida Engineering, Transactions of the ASME, pp. 198–202, Sep. 1974, disclose experiments to obtain information concerning the action of high velocity liquid jets impacting at velocities that erode the target surface.

M. Hashish, *Steel Cutting with Abrasive Waterjets,* Sixth Intl. Symposium on Jet Cutting Technology, April 6–8, 1982, pp. 465–487, discloses steel cutting with high velocity abrasive waterjets. Also, M. Hashish, *On the Modeling of Abrasive-Waterjet Cutting,* Seventh Intl. Symposium on Jet Cutting Technology, Jun. 26–28, 1984, pp. 249–265, discloses an effort to model the abrasive-waterjet cutting processes by visualization of the cutting interface and an analysis of the erosion process by abrasive-waterjets. Also, by Hashish, *Pressure Effects in Abrasive-Waterjet Machining,* Journal of Engineering Materials and Technology, July 1989, Vol. III, pp. 221–228, discloses abrasive-waterjets that are formed by mixing high pressure waterjets with abrasive particles and mixing typical inlet/discharge ratios of 50 to 100. Krasnoff, U.S. Pat. No. 4,723,387, discloses both a batch operation and a continuous operation for supplying pressured liquid and a pressured slurry to an abrasive-jet cutting nozzle.

Drawbacks of fluid or water abrasive jet cutting has always been the slowness of the jets cutting speed on materials such as metals as well as other thick or dense materials. Many methods of overcoming this problem have been tried. Current attempts at increasing cutting speed include increasing the pressure of the waterjet, using a larger orifice, using a sharper or harder form of abrasive, and achieving a more coherent stream. However, the more viscous the fluid layer surrounding each particle, the more energy required to penetrate the target material. This reduces the amount of energy available to cut the target material.

As a result, a need exists for a fluid jet cutting composition and method which penetrates not only solution existing on the surface of the substrate to be cut, but also penetrates the surface itself at a higher velocity than now presently available through current methods.

SUMMARY OF THE INVENTION

In accordance with the invention there is provided an improved abrasive fluid jet cutting composition. In accordance with a further aspect of the invention there is provided a method for cutting reactive and non-reactive substrates using the composition of the invention. In accordance with another aspect of the invention there is provided finished articles resulting from the method of the invention.

In its most preferred embodiment, compositions and methods of the invention comprising water may be used to cut reactive materials; compositions comprising a fluid and an abrasive may also be used to cut reactive materials; and compositions comprising a fluid carrier, an abrasive and a surface active agent may further be used to cut reactive and non-reactive materials.

The claimed invention is applicable to both entrainment fluid jet and slurry fluid jet processes and increases cutting speed by reducing surface tension of the fluid/gas/abrasive composition. The claimed invention is a method and composition for cutting material using an abrasive particulate entrained within a high pressure, high velocity stream of fluid which includes a surface tension altering constituent.

While only a theory, on which they do not wish to be bound, Applicants believe that the cutting efficiency of the claimed composition is related to the layer of fluid surrounding each particle as it impacts the target material. When fluid compositions not containing surface tension altering constituents impact the substrate, the particle must penetrate a layer of fluid surrounding the particle. The more viscous the fluid layer, the more energy required to penetrate the target material. Further, efficiency suffers without proper fluid composition including the proper fluid/gas/abrasive mixture. This reduces the amount of energy available to cut the target material.

The claimed composition also reduces cutting energy precluding the remigration of the cut material or the abrasive particle into the substrate.

The invention may also reduce the pressure required to push the fluid through the narrow orifice used to form the fluid jet prior to the abrasive mixing. A more viscous flow may move slowly due to the boundary layer friction and surface tension. This increases the energy necessary to project the fluid through an orifice and, in turn, reduces the flow rate preventing more abrasives from being entrained within the stream.

In its most preferred embodiment, the invention is applied to munitions manufacturing, disposal and destruction including munitions such as ammonium perchlorate (AP); 2,4,6-trinitro-1,3-benzenediamine (DATB); ammonium picrate (Exp D); octahydro-1,3,5,7-tetranitro-1,3,5,7-tetrazocine (HMX); nitrocellulose (NC); nitroguanidine (NG); 2,2-Bis[(nitroxy)methyl]-1,3 propanediol dintrate (PETN); 2,4,6 trinitrophenol (TNP); hexahydro-1,3,5-trinitro-1,3,5-triazine (RDX); 2,4,6-trinitro-1,3,5-benzenetriamine (TATB); N-methyl N-2,4,6 tetranitro benzeneamine (TETRL); and 2-methyl-1,3,5 trinitrobenzene (TNT); among others.

For purposes of this invention, "reactive" means a material which is, or may become, combustible, flammable, explosive or otherwise reactive when subjected to processing such as fluid jet cutting.

DETAILED DESCRIPTION OF THE PREFERRED EMBODIMENTS

The invention comprises a liquid cutting fluid, a process for removing material using this fluid and articles resulting from the application of this fluid jet on various substrates.

The Fluid Cutting Composition

The abrasive fluid jet composition of the invention comprises a carrier, an abrasive, and preferably a surface active agent. The carrier functions to support the composition in a storage stable form as well as deliver the composition to the intended substrate. Further, the carrier maintains the fluid in a manner which facilitates the removal of material once in contact with the intended substrate. To this end, the carrier generally has physical and chemical characteristics consistent with these functions. In use of fluid cutting compositions, the cutting of given material can be completed by physical means such as cutting, plowing, or rubbing as well as chemical means such as oxidative reaction when the appropriate compositional constituents are present in the fluid.

Preferably, the carrier will have a density ranging from about 0.5 to 2 gm/ml, preferably from about 0.65 to 1.5 gm/ml and most preferably from about 0.8 to 1.2 gm/ml at 20° C. Also, the carrier is preferably nontoxic so as to maintain the environmental usefulness of the cutting composition. Generally, for slurry fluid jet systems the carrier comprises a major portion of the composition, preferably from about 50 wt-% to 90 wt-%, and most preferably from about 65 wt-% to 75 wt-%. For entrainment jet systems the carrier generally comprises about 80 wt-% to 99.9 wt-%, preferably about 90 wt-% to 98 wt-%, and most preferably about 92 wt-% to 96 wt-% of total fluid flow.

The carrier may be aqueous, organic, or mixtures thereof. Any number of organic solvents may be used. Generally, the organic solvents may be chosen from alkyl alcohols, alkyl ketones, alkyl nitriles, nitroalkanes, and halo-alkanes. More particularly, the alkyl group of the organic solvent may be branch, cyclic, or straight chain of from 3 to 20 carbons. Examples of such alkyl groups include octyl, dodecyl, propyl, pentyl, hexyl, cyclohexyl, and the like. The alcohols may also be composed of such alkyl groups. The ketones include such solvents as acetone, cyclohexanone, propanone, and the like. The nitro compounds include such solvents as acetonitrile, propylnitrile, octylnitrile, and the like. Examples of halogenated alkanes include methylene chloride, chloroform, tetrahaloethylene or perhaloethane, and the like. Mixtures of the foregoing organic compounds can also function as an organic solvent.

Especially preferred mixtures include gasoline or diesel fuel or long chain hydrocarbons as the cutting or removal solvent and short chain alcohols, nitriles, halogenated alkanes and ketones such as acetone acetonitrile propane, ethanol and propanol as carriers.

While the carrier may comprise any number of aqueous, organic, or aqueous organic mixtures, the carrier preferably is capable of producing a low viscosity fluid jet which can pass through an orifice of about 0.002 inch to 0,054 inch. Preferably, aqueous or aqueous organic mixtures are used as these provide a carrier which is nontoxic and cost effective given compatibility with the material to be cut. Such carriers include, for example, propylene and ethylene glycol, fuel oil, water, short chain alkyl alcohols, mineral oil, glycerine, or mixtures thereof. Further, we have found that explosives may be cut safely by a 20,000 psi (or greater) flow of water, alone without an abrasive.

The carrier may also comprise an aromatic or heterocyclic compound such as toluene, xylene, furan or pyran compounds such as tetrahydrofuran, cyclohexane, napthalenes, carbonates such as diethyl carbonate, sulfur compounds such as dimethyl sulfoxide, pyrrolidone compounds such as n-methyl pyrrolidones as examples.

The composition of the invention also comprises abrasive particles intended to remove material or finish the substrate to which it is made incident. Removal in this context means milling, cutting, turning, abrading, peening, and the like. Generally, any particle capable of material removal may be used in accordance with the invention. The relative effectiveness of the abrasive is somewhat dependent upon the intended substrate. When the substrate is hard, the type of abrasive material will have a significant effect. For softer materials, the effect is less significant.

Generally, abrasives found useful in accordance with this invention are those shapes which either have sharp edges or are friable meaning capable of fracturing into a sharp cutting edge such as, for example, octahedron or dodecahedron shaped particles. Exemplary materials useful as abrasives include glass, silica sand, iron, silicon carbide, as well as elemental metal and metal alloy slags and grits. Also useful as preferred abrasives are garnet and aluminum oxide. The abrasives may also be an encapsulate particle. For example, any of the preceding materials may be coated with an agent tending to provide a given physical or chemical effect. Encapsulating coatings may be any composition which, preferably, maintains the free flowing capability of the abrasive while imparting a given effect to processing. For example, abrasives may be coated with oxidation agents such as permanganates.

The particle size of these abrasives may range generally to any size which is capable of removing material from the intended substrate while also forming a homogenous fluid with the other constituents of the composition. Useful particle sizes have been found to be from about 7 mesh to 270 mesh (2.8 mm to 53 microns), preferably about 12 mesh to 150 mesh (1.4 mm to 106 microns) and most preferably about 60 to 115 mesh (250 microns to 125 microns). Generally, most preferred abrasives have been found to be garnet or aluminum abrasives having a particle size ranging from about 60 to 115 mesh.

The concentration of the abrasive within the composition may range generally in slurry fluid jet systems from about 1 to 50 wt-%, preferably from about 10 to 40 wt- %, and most preferably from about 25 to 35 wt-%. For entrained fluid jet systems the abrasive generally comprises about 5 wt-% to 30 wt-%, preferably 10 wt-% to 25 wt-% of total fluid flow depending on nozzle diameter such as diameters of about 0.01 inch. Increasing the concentration generally has a tendency to increase the cutting efficacy of the composition.

However, increasing the concentration of abrasive to a higher level may also tend to increase the viscosity of the fluid jet cutting composition while diminishing the ability of the composition to actively penetrate the substrate and remove material. In contrast, diminishing the concentration of the abrasive may tend to reduce the viscosity of the fluid jet cutting composition while at the same time diminishing the efficacy of the cutting composition in effectively removing material.

The fluid jet cutting composition preferably also comprises a surface active agent useful in reducing the surface tension of the composition.

Applicants believe that the surface active agent reduces the size of the entrained gas bubbles resulting from dissolution or cavitation. The surface active agent also enhances mixing of the compositional elements while reducing the fluid boundary layer around the particles and reducing the frictional interaction between the particles. The surface active agent may also facilitate oxidative decomposition of the material or substrate. These advantages are pronounced through mixing, projection through the orifice and nozzle, and projection onto the substrate. Further, the surface active agent may be used, in cases of extreme pressure to depress freezing point depression, allowing the invention to be subjected to higher pressures. Notably, cutting efficiency increases with increasing pressure.

To impact the substrate, the abrasive particle must penetrate the layer of fluid surrounding the particle. The claimed composition allows for cutting material using abrasive particulates entrained within a high pressure and velocity stream of fluid which has had its surface tension decreased either by the inclusion of a surface active agent to the stream of fluid or the selection of a fluid for the abrasive carrier which has a low surface tension.

While Applicants do not wish to be held to a theory, the increase in cutting speed is believed to be directly related to the layer of fluid surrounding each particle as it impacts the target material. The more viscous the fluid layer, the more energy required to penetrate the target material. This reduces the amount of energy available to cut the target material.

Coincidentally, the inclusion of a surface tension lowering material also reduces the pressure required to push the fluid through the narrow orifice used to form the fluid jet prior to abrasive mixing. The overall energy required to push the fluid through the orifice is thereby decreased and theoretically the flow rate will increase with more abrasive entrained in the fluid for a given pressure. If the fluid is more viscous, flow may be slowed due to boundary layer friction. The more laminar the flow, the less mixing of the abrasive fluid due to the lack of non-turbulent flow characteristics of the fluid flow. The effect the surfactant has on fluids is to modify the gas-liquid interface directly and interact with the liquid-solid interface indirectly.

By reducing the surface tension of the gas-liquid interface, the surfactant reduces the size of gas bubbles entrained in solution and reduces viscosity as well. This has direct value for an abrasive fluid jet as the jet is a three phase stream of liquid, gas, and solid abrasive particle. By reducing the bubble size of the gas entrained in the stream, more space is available for the abrasive, the stream becomes more coherent and homogenous, and the abrasive particle has a more complete surface activity with less viscosity in the fluid. This phenomenon enhances the cutting efficacy of the individual abrasive particles.

In sharp contrast, if the abrasive is entrained only in the outer layers of the jet, the abrasive in the jet is delivered primarily to that portion of the substrate where the cutting action is desired.

Surface tension altering constituents such as surface active agents or surfactants are preferably freely miscible with carriers to significantly reduce the surface tension of the fluid jet cutting composition. Generally, surfactants comprise a wide variety of compounds which are generally classed as anionic, cationic, nonionic, and amphoteric. These surfactants may be produced through well known methods from precursors such as fluorocarbons, fatty acids, amines, sulfates, esters, and alcohols.

Exemplary surfactants include sulfonic acids, sulfonates, alkylates, ether sulfates, ethoxylates, aliphatics, polyethers, alkylamine oxides, alkylbutanes, diethanolamines, lauryl sulfates, ethoxylated esters, fatty acid alkoxylates, fatty diethanolimides, fluorinated surfactants, glycerol monostearates, lauric diethanolamines, oleic acid, dimethylamines, phosphate esters, polyethylene glycol monooleates, quaternary alkyl amines, sulfylsuccinates, tridecyloxypoly(ethyleneoxy) ethanols, and the like.

Generally, preferred surfactants include anionic surfactants such as ammonium alkyl sulfonates, potassium alkyl carboxylates; cationic surfactants such as alkyl quaternary ammonium chloride and fluoroalkyl quaternary ammonium chloride; nonionic surfactants such as fluorinated alkyl esters, alkyl polyoxy ethylene ethanols; and amphoteric surfactants such as N-ethyl $\beta$ alamine, and N-benzyl $\beta$ alamine. Additionally, mixtures of the above-referenced surfactants may also be used in accordance with the invention.

The concentrations of these surfactants may range from a few ppm to a major portion of the cutting jet fluid. For slurry fluid systems the surface active agent may comprise about 0,001 wt-% to 10 wt-%, preferably about 0.01 wt-% to 5 wt-% and most preferably about 0.05 wt-% to 1 wt-% of the total composition. Generally, the surface active agent in entrained fluid jet systems is used at a concentration ranging from about 0,001 wt-% to 10 wt-%, preferably from about 0.01 wt-% to 5 wt-%, and most preferably from about 0.05 wt-% to 1 wt-% of total fluid flow.

The Cutting Process

Generally, the cutting process of the invention may comprise two steps including mixing the cutting jet fluid and applying the fluid to the intended substrate. The fluid constituents may be mixed through any number of processes known to those of skill in the art including aspirated mixing during application.

Methods of introducing or mixing the abrasive composition include: aspiration by introducing the surface active agent into the carrier fluid after the carrier has left an orifice thereby drawing the surface active agent into the carrier by vacuum; pumping a predetermined amount of surfactant or surface active agent into the carrier; intravenous mixing by introducing the surface active agent into the carrier in a low pressure zone applicable to batch processing; through concentrate or premix; and through direct injection among other methods. We have found that prewetting the abrasive does not accommodate use in an entrained fluid jet system due to agglomeration and clogging.

Generally, the cutting process may be completed by selecting the appropriate abrasive, carrier, and surface active agent for the target material given consideration of whether a reactive material is present. A fluid pressure and speed is then selected given the reactive material present. An abrasive is also selected which does not create a piezoelectric or piezoresistive charge in the material to be cut. The substrate is then aligned making sure that cutting wastes are captured for disposal. The substrate may then be cut by means known to those of skill in the art such as by using a traverse or plunge cut. Applicants have found that the claimed process is applicable to highly reactive compositions including explosives such as 2,2-Bis[(nitroxy)methyl]-1,3-propanediol. dinitrate at pressure ranging about 150,000 psi.

Generally, once mixed, the fluid is applied to the intended substrate. While any number of application methods may be used in accordance with the invention, the fluid is generally applied at about 0.1 to 10 lpm, preferably about 1 to 7 lpm, and most preferably about 3 to 4 lpm.

Moreover, the fluid may be applied at a pressure significantly less than other cutting fluids used with prior compositions due to the inclusion of the surface active agent and generally at about 40 to 1,000,000 psi, preferably from about 35,000 to 120,000 psi, and most preferably from about 45,000 to 60,000 psi.

We have also found that a fluid jet orifice having a diameter of about 0.001 to 1.5 inch, preferably from about 0.007 to 0.1 inch, and most preferably from about 0.01 to 0.054 inch have provided the greatest cutting efficacy.

Generally, the fluid is applied to either remove material from or finish the intended substrate. Accordingly, any number of apparatus may be used known to those of skill in the art including sandblasting devices, fluid-abrasive nozzle devices, guns for forming jets of particulate material, wet abrasion blasting devices, abrasive jet drilling devices, abrasive jet nozzles, pressure intensifiers, and the like. Any number of abrasive jet cutting approaches may also be used consistent with the invention including single jet-single feed processes, multiple jet-central feed processes, annular jet-central feed processes, single jet-external feed processes, direct pumping processes, indirect pumping processes, and the like.

If aspiration is used, the abrasive may be transported into the fluid by the venturi-affect or the vacuum created by the fluid flow through the orifice. Gases found useful in transporting the abrasive include air, $O_2$, ozone, inert gases such as argon, nitrogen and the like. Gases may also be selected to either further degrade or prevent reaction of the substrate apart from the physical action of the abrasive. For abrasive compositions of water, water/surfactant blend, organic, organic/surfactant blend the following pressures and nozzle sizes have been found appropriate.

| | USEFUL | PREFERRED | MOST PREFERRED |
|---|---|---|---|
| Pressure (ksi) | 0.001–500 | 20–100 | 35–80 |
| Orifice Size (inches) | 0.001–1 | 0.007–0.1 | 0.01–0.054 |
| Nozzle Size (inches) | 0.001–1 | 0.01–0.15 | 0.025–0.080 |

Applications

The abrasive jet fluid composition of the invention may be used to cut any number of materials.

For example, any number of organic, or inorganic, inert materials may be cut including wood, stone, glass, natural and synthetic weaves, metals and metal alloys, and synthetic polymer composite among others. The invention may also be used to cut highly reactive chemicals, substrates and other materials including alkali and alkaline earth metals such as lithium, sodium, zirconium, calcium, etc.; reactives including explosives, pyrotechnics and propellants; flammables and combustibles such as thermoplastics and thermosetting polymers; and armaments such as for example, metal encased reactive shells.

Also, substrates which may be cut by the composition of the present invention include any materials which may have a low tolerance for heat, vibration and shock and therefore would not survive conventional cutting processes.

Other materials which may be processed in accord with the invention include any number of metals, including elemental metals and metal alloys; ceramics such as zirconia, silicon carbide, aluminum oxide compounds, cobalt ceramics, zirconia manganese ceramics, aluminum oxide ceramics, among others; crystals and glasses, including silica glass, epoxy glass composites, and the like; aggregates; organic polymers and composites, such as thermoplastic and thermosetting polymers and composites, carbon composites, graphite/epoxy composites, and steel reinforced composites; paper products, including paper, wafer board, cardboard, and the like; stones and mineral compounds, chemical compounds, and woods.

WORKING EXAMPLES

Applicants now provide the following working examples which are illustrative of the invention but should not be construed as limiting the scope of the invention.

An Ingersoll-Rand 40 hp waterjet cutting machine was used having a remote cutting head, a cutting pressure range of from 12 kpsi to 50 kpsi and a cutting fluid flow rate of approximately 0.5 to 2 liters per minute depending on orifice size. Orifices used in this test were 0.010 and 0.014 inches.

Four types of test specimens were used in this testing: 1) modified 25 mm high explosive incendiary projectiles, ogive removed filled with PETN, an RDX mixture or inert simulant; 2) a 4.2 inch mortar projectile, empty or loaded with a band of RDX and TNT mixture at the center of projectile; 3) modified 4.2 inch mortar projectiles; aft end removed and ogive filled with a RDX and TNT mixture; and 4) aluminum holders loaded with 0.1 inch diameter x 0.1 inch long column of Lead Azide.

The Ingersoll-Rand water jet cutting machine was set up with the cutting head mounted on a steel shield and placed on a cement pad.

Using a 50/50 Ethylene Glycol/Water cutting fluid mixture the maximum feed rate, maximum pressure (45 KPSI) and maximum abrasive feed rate (0.5 LB/MIN)

to cut 25 mm inert projectiles was determined. This cutting was performed with the 0.010 inch orifice x 0.035 inch nozzle.

The Same procedure was then run to determine fluid effects with a 0.014 inch orifice x 0.040 inch nozzle at the maximum abrasive feed rate for this nozzle to determine max cutting rate.

The conditions developed were then used to cut five PETN projectiles. The maximum cutting rate was then determine for a rotating 4.2 inch projectile at 45 KPSI and 0.5 165/min abrasive (garnet) feed rate. The rate resulting was then used to cut three 4.2 inch mortar projectiles filled with a TNT/RDX mixture.

Projectile loaded on feed table. Water jet machine started (cutting head valve off). The cutting head was turned on. Abrasive flow was started. Feed table started. Cutting was performed. Abrasive flow was stopped. The cutting head was turned off. Projectile removed from the table. Feed table was returned to starting position.

The plunge cuts and rotational cuts deviated from this procedure. During the plunge cutting the feed table was advanced to center the projectile on the cutting head prior to the head being turned on and was not moved during the cut. During the rotational cut the procedure was altered to accept a projectile mounted in a rotation fixture.

A cutting rate of 2.44 In/Min for the 25 mm projectile was determined for the 50/50 Ethylene Glycol Water mix after cutting approximately 12 inert rounds. (See Table 1, Samples A to I). Previous testing with water only displayed a max cutting rate of 1.60 In/Min for the 25 mm projectiles with the same 0.010 orifice. Verification of this 50% increase in cutting rate was completed by switching back to water and reverifying the 1.60 In/Min cutting rate. (See Table 2, Samples HH through YY. 142.18, for this data).

The maximum abrasive flow rate was specified by the Ingersoll-Rand service technician as 0.5 Lb/Min for the 0.010 Orifice. A separate 5 round test series (Table 1, Samples J through N) was run by incrementally increasing the grit flow to 0.837 Lb/Min. This resulted in a cutting rate increase to 3.05 In/Min.

A maximum cutting rate with the 0.014 inch orifice x 0.040 inch nozzle was determined to be 4.41 In/Min at a grit flow rate of 1.57 Lb/Min. This testing was performed on RDX mixture loaded projectiles instead of inert projectiles. (See Table 1, Samples S through BB for this data).

Five PETN loaded projectiles (25 mm) were cut at the 4.41 In/Minute rate with no reaction occurring. (See Table 1, Samples CC through GG).

A maximum cutting rate of 1.82 Rev/Min (cutting time 33 sec.) was obtained on the 4.2 inch mortar projectiles with the 0.014 x 0.040 inch nozzle and a 50/50 Glycol/Water mix. (See Table 3, number AAA through HHH for this data). This compares to a 0.65 Rev/Min (Cutting time 93 sec) with the 010 x 0.035 inch nozzle and water.

TABLE 1

| SAMPLE | EXPL. TYPE | PUMP. PRES. (KPSI) | ABRA. RATE (LB/MN) | FEED RATE (IN/MN) |
|---|---|---|---|---|
| A | INERT | 42 | .52 | 1.60 |
| B | " | " | " | 1.87 |
| C | " | " | " | 1.87 |
| D | " | " | " | 2.22 |
| E | " | " | " | 2.22 |

TABLE 1-continued

| SAMPLE | EXPL. TYPE | PUMP. PRES. (KPSI) | ABRA. RATE (LB/MN) | FEED RATE (IN/MN) |
|---|---|---|---|---|
| F | " | " | .509 | 2.22 |
| G | " | " | .507 | 2.22 |
| H | " | " | " | 1.83 |
| I | " | " | " | 2.44 |
| J | " | " | .638 | 2.74 |
| K | " | " | .638 | 2.74 |
| L | " | " | " | 3.05 |
| M | " | " | .757 | 3.05 |
| N | " | " | .837 | 3.05 |
| O | " | " | .505 | 1.87 |
| P | " | " | " | 2.44 |
| Q | " | " | " | 2.44 |
| R | " | " | " | 2.22 |
| S | INERT | 42 | 2.09 | 4.06 |
| T | RDX Mixture | " | " | 5.50 |
| U | " | " | 1.986 | 5.50 |
| V | " | " | 1.793 | 4.87 |
| W | " | " | 2.38 | 4.87 |
| X | " | " | 2.05 | 4.41 |
| Y | " | " | 1.563 | " |
| Z | " | " | 1.057 | " |
| AA | " | " | 1.330 | " |
| BB | " | " | 1.577 | " |
| CC | PETN | " | 1.577 | " |
| DD | PETN | " | 1.577 | " |
| EE | PETN | " | 1.577 | " |
| FF | PETN | " | 1.577 | " |
| FF | PETN | " | 1.577 | " |

TABLE 2

| SAMPLES | EXPL. TYPE | PUMP. PRES. (KPSI) | ABRA. RATE (LB/MN) | FEED RATE (IN/MN) |
|---|---|---|---|---|
| HH | RDX Mixture | 45 | .5 | 1.37 |
| II | " | " | " | " |
| JJ | " | " | " | 1.56 |
| KK | " | " | " | " |
| LL | " | " | " | 1.83 |
| MM | " | " | " | " |
| NN | " | " | " | 2.09 |
| OO | " | " | " | " |
| PP | " | " | " | 2.28 |
| QQ | " | " | " | " |
| RR | " | " | " | 2.35 |
| SS | " | " | " | " |
| TT | " | " | " | 2.44 |
| UU | " | " | " | " |
| VV | " | " | " | 2.77 |
| WW | " | " | " | " |
| XX | " | " | " | 3.05 |
| YY | " | " | " | " |
| ZZ | " | " | " | " |
| AAA | " | " | " | 2.44 |
| BBB | " | " | " | " |

TABLE 3

| SAMPLE | EXPL. TYPE | PUMP. PRES. (KPSI) | ABRA. RATE (LB/MN) | FEED RATE (IN/MN) |
|---|---|---|---|---|
| AAA | INERT | 37 | 1.52 | 1.43 |
| BBB | " | " | " | 1.62 |
| CCC | " | " | " | 1.81 |
| DDD | " | " | " | 2.14 |
| EEE | " | " | " | 1.93 |
| FFF | TNT/RDX | " | " | 1.81 |
| GGG | " | " | " | " |
| HHH | " | " | " | 1.81 |

The above discussion, examples, and embodiments illustrate our current understanding of the invention. However, since many variations of the invention can be made without departing from the spirit and scope of the invention, the invention resides wholly in the claims hereafter appended.

We claim as our invention:

1. A method for cutting an explosive material through application of a fluid comprising an effective suspending amount of carrier, an effective reactive material cutting amount of an abrasive and an effective surface tension reducing amount of surface active agent, said method comprising the steps of:

(a) mixing said carrier and said surface active agent;

(b) introducing said abrasive into said carrier/surface active agent mix; and (c) projecting the fluid onto the explosive material from a fluid jet orifice of a fluid jet at a pressure of between about 0.001 to 500 kpsi wherein the fluid jet orifice has a projected diameter of about 0.001 to 1.5 inch and wherein said fluid is directed toward said explosive material at a rate of about 0.1 to 10 liters per minute.

2. The method of claim 1 wherein said abrasive comprises garnet having a mesh size ranging from about 7 to 270 mesh.

3. The method of claim 1 wherein said fluid is directed onto said explosive material at a pressure ranging from about 40 to 1 million pounds per square inch.

4. The method of claim 1 wherein said fluid is directed in a beam jet, said beam jet having a flow rate ranging from about 1 to 7 lpm.

5. The method of claim 1 wherein the carrier comprises water.

6. The method of claim 1 wherein the carrier is selected from the group consisting of water, alkyl alcohols, alkyl ketones, alkyl nitriles, nitro alkanes, halo alkanes, and mixtures thereof.

7. The method of claim 1 wherein the abrasive is selected from the group consisting of glass, silica sand, iron, copper slag, steel grit, silicon carbide, garnet, aluminum oxide, or mixtures thereof.

8. The method of claim 1 wherein the abrasive comprises particles having a mesh size ranging from about 7 to 270 mesh.

9. A method for cutting explosive material through application of an aqueous fluid comprising from about 65 wt-% to 75 wt-% of water, from about 0.01 wt-% to 5 wt-% of surface active agent, and from about 10 wt-% to 40 wt-% abrasive, said method comprising (a) mixing said water and said surface active agent;

(b) introducing said abrasive into said water/surface active agent mix; and (c) projecting aqueous fluid onto the explosive material from a fluid jet orifice of a fluid jet at a pressure of between about 20 to 100 kpsi wherein the fluid jet orifice has a projected diameter of about 0.007 to 0.1 inch and wherein the aqueous fluid is directed into said explosive material at a rate of about 0.1 to 10 liters per minute.

10. The method of claim 9 wherein the aqueous fluid is projected onto the explosive material at a pressure between about 35 to 80 kpsi and the fluid jet orifice has a projected diameter of about 0.01 to 0.54 inch.

11. A method for cutting a munition through application of an aqueous fluid comprising about 65 wt-% to 75 wt-% of water, about 0.01 wt-% to 5 wt-% of surface active agent, and from about 10 wt-% to 40 wt-% of abrasive, said method comprising the steps of:

(a) mixing said water and said surface active agent;

(b) introducing said abrasive into said water/surface active agent mix to produce such aqueous fluid; and (c) projecting said aqueous fluid onto the munition at a pressure of between about 35 to 80 kpsi, from a fluid jet orifice of a fluid jet wherein the fluid jet orifice has a diameter of about 0.01 to 0.054 inch; and wherein the aqueous fluid is directed onto the munition at a rate of about 0.1 to 10 liters per minute, and wherein said abrasive is selected from the group consisting of glass, silica sand, iron, copper slag, steel grit, silicon carbide, garnet, aluminum oxide and mixtures thereof having a particle mesh size ranging from about 12 to 150 mesh.

* * * * *

UNITED STATES PATENT AND TRADEMARK OFFICE

CERTIFICATE OF CORRECTION

PATENT NO. : 5,363,603

DATED : November 15, 1994

INVENTOR(S) : Paul L. Miller et al.

It is certified that error appears in the above-identified patent and that said Letters Patent is hereby corrected as shown below:

On column 4, line 7, please delete "0,054" and substitute therefore --0.054--

On column 4, lines 53 and 54, please delete "homogenous" and substitute therefore --homogeneous--

On column 6, lines 1 and 2, please delete "homogenous" and substitute therefore --homogeneous--

On column 6, line 43, please delete "0,001" and substitute therefore --0.001--

On column 6, line 47, please delete "0,001" and substitute therefore --0.001--

On column 9, line 10, please delete "determine" and substitute therefore --determined--

On column 9, line 56, please delete "number" and substitute therefore --Samples--

On column 9, line 58, please delete "010" and substitute therefore --0.010--

On column 9, line 64, please delete "SAMPLE" and substitute therefore --SAMPLES--

On column 10, line 4, please delete "SAMPLE" and substitute therefore --SAMPLES--

On column 10, line 56, please delete "SAMPLE" and substitute therefore --SAMPLES--

UNITED STATES PATENT AND TRADEMARK OFFICE

CERTIFICATE OF CORRECTION

PATENT NO. : 5,363,603 Page 2 of 2

DATED : November 15, 1994

INVENTOR(S) : Paul L. Miller et al.

It is certified that error appears in the above-identified patent and that said Letters Patent is hereby corrected as shown below:

On column 10, line 28, please delete "FF" and substitute therefore --GG--

On column 12, line 8 (claim 9), please insert --:-- after the word "comprising"

On column 12, line 22 (claim 10), please delete "0.54" and substitute therefore --0.054--

Signed and Sealed this

Twenty-eight Day of February, 1995

*Attest:*

Bruce Lehman

BRUCE LEHMAN

*Attesting Officer*

*Commissioner of Patents and Trademarks*